United States Patent [19]

Dyck

[11] 4,086,837

[45] May 2, 1978

[54] STAMPING AND CUTTING DIE-SET WITH INTERCHANGEABLE DIE-PLATES

[76] Inventor: Manfred Dyck, Calenberger Strasse 31, 3204 Nordstemmen, Germany

[21] Appl. No.: 728,157

[22] Filed: Sep. 30, 1976

[30] Foreign Application Priority Data

Oct. 3, 1975 Germany ..... 2544239

[51] Int. Cl.[2] ..... B26D 7/26; B26F 1/44

[52] U.S. Cl. ..... 83/698; 83/699; 83/700; 83/685; 83/637

[58] Field of Search ..... 83/698, 699, 700, 685, 83/637

[56] References Cited

U.S. PATENT DOCUMENTS

| | | | |
|---|---|---|---|
| 2,089,795 | 8/1937 | Hodge | 83/698 X |
| 2,271,540 | 2/1942 | Bucke | 83/698 X |
| 2,379,271 | 6/1945 | Bechtel | 83/637 |
| 3,871,177 | 3/1975 | Sauer | 83/698 X |
| 3,880,038 | 4/1975 | Mangos | 83/685 |
| 3,908,500 | 9/1975 | Gargrave et al. | 83/700 |

*Primary Examiner*—Donald R. Schran
*Attorney, Agent, or Firm*—Gilbert L. Wells

[57] ABSTRACT

A stamping and cutting die-set having exchangeable die plates consisting of an upper and a lower part connected by means of guides and serving to secure at least one cutting die locked by means of at least one clamping system.

Two centering pins (3) with conical tips (3*a*) pointing to the interior of the die-set are located no less than two each in the upper and lower parts (11,1) so as to be displaceable inside boreholes (13*a*) extending normally to the plane of the plates, these pins each being loaded by strong springs (5), and the tips (3*a*) of these pins projecting towards the inside of the die-set when the die-plates (2,21) are removed. The die-plates are provided with correspondingly designed hollowconical recesses (4) which are entered by tips (3*a*) of centering pins (3), which are pre-loaded, after die plates (2,21) are locked by means of clamping system (6,7).

7 Claims, 5 Drawing Figures

STAMPING AND CUTTING DIE-SET WITH INTERCHANGEABLE DIE-PLATES

Stamping and cutting die-set with interchangeable die-plates.

The invention relates to a stamping and cutting die-set with interchangeable die plates, consisting of an upper and lower part connected by guides serving to fasten at least one die plate by at least one clamping system.

As regards known tools of this kind, the die-plates are connected with the upper and lower parts by means of screws. Such connection is complex and laborious and in most cases requires that the entire tool — that is, including the upper and lower parts and the guides — be removed from the punch machine or press. This is particularly the case in the conventional case of known tools when fitting or adjusting pins are provided between the upper and lower parts and the die-plates to maintain latter within tolerances, said pins acting on the die-plates or the upper or lower parts being pre-loaded. Such adjusting pins can be removed only by applying some force and most of the time only after the tool has been removed from the punch machine or press.

The invention therefore addresses the problem of so designing a stamping and cutting die-set of the kind initially discussed that the die-plates may be simply and easily changed without thereby degrading their adjustments regarding the connection with the upper and lower parts. Such a change of the die-plates shall be especially feasible for a die-set built into the stamping machine or press.

The invention solves this problem by providing at least two centering pins each in the upper and lower parts, the conical tips of said pins pointing toward the inside of the die-set being displaceably held in boreholes extending normally to the planes 24 of the plates and always said pins being loaded by strong springs, said tips projecting toward the inside of the die-set when the die-plates are removed, and the die-plates being provided with corresponding hollow conical recesses which will be entered by the tips of the centering pins — which are preloaded — after the die-plates have been locked by means of the clamping system.

This arrangement achieves that no more than detaching the clamping system is required to change the die-plates, which then may be removed. The laborious dismantling of the die-plates from the upper and lower parts in the presence of applied force — as is required when using fitting pins in known equipment — therefore no longer is needed. When mounting the same or other die-plates again, they merely need be assembled in such manner that the tips of the centering pins enter the hollow, conical clearances, whereupon the clamping system is tightened. Loading the centering pins with strong springs automatically so trues the die-plates by the method of the invention when the clamping system is tightened that said pins and clearances are flush with one another. This truing takes place within the play of the clamping system which, as regards the known ones, exceeds by at least one decade the fit of the connection between centering pins and hollow, conical recesses. Clearly such a change also is immediately possible for a built-in die-set, so that the arrangement of the invention already saves appreciably by reducing all the time the machine otherwise would be inoperative. The arrangement of the invention furthermore offers the advantage that the die-plates may also be changed by assistants without there being the danger of their damaging the tool and/or the die-plates.

The back ends of the centering pins appropriately are provided each with a flange of larger diameter than the borehole in which are located the springs loading them, said flanges acting as stops and preventing the pins from leaving the bores.

In order to provide a stop for the flange inside the upper or lower parts and to do so in simple manner, the guidance for the centering pins advantageously is formed by a bore in a special insert of the upper or lower part which covers the bore in the upper or lower part holding the spring. This offers the further advantage that the guidance may be fabricated very precisely in the relatively small insert and that the latter where appropriate may consist of a more wear-resistant material than the upper or lower part.

For a die-set built as the conventional post-structure and provided with two guide posts mounted on one side next to the die-plates, two centering pins are appropriately provided for each of the upper and lower parts, and mounted diagonally with respect to the surface of the die-plates, two clamping systems being mounted symmetrically with respect to the centering pins on the other diagonal. In this manner one obtains the largest possible distance between the two centering pins to increase the accuracy.

On the other hand, as regards a post-structure with two guide posts encompassing the die-plates, the centering pins provided for the upper and lower parts may be arrayed in a line with the guide posts, two clamping systems being mounted on both sides next to each centering pin, so that larger die-plates may be reliably secured by this method.

The clamping systems may be screws known per se. But it is particularly advantageous that the clamping systems each consist of a bolt the head of which is housed in a recess of the die-plate, resting on it, its shank engaging a clearance of the upper or lower part, the shank itself being provided with a clearance penetrated by a clamping pin guided approximately horizontally in the upper or lower part and drawing said bolt against said upper or lower part.

Inserting the clamping pin in this manner, by the pin's horizontal motion, allows locking the die plates against the upper or lower part, so that removal of the die-plates without dismantling the die-set is possible even when the latter is narrow and/or when the die-plates are thick. In every case there will be accessibility and operability of the clamping system.

It is particularly advantageous that the clearance be at the surface of the bolt shank and that the clamping pin be eccentrically rotatable. In such a design the clamping pin need merely be inserted into the guidance of the upper or lower part and be rotated until the die-plate has been pulled over the bolt against the upper or lower part.

Appropriately the clamping pin should be secured in its clamping position by a lock mounted externally to the upper or lower part. Securing and detaching the clamping pin from the outside will be feasible in this manner too without requiring dismantling the overall die-set.

The lock appropriately consists of a forklike bracket overlapping that end of the clamping pin projecting from the upper or lower part, the collar of said bracket being screwed to the upper or lower part and its prongs being held together by means of a screw.

In order to accept also so-called overall blanking tools consisting of at least one cutting stamp with wiper and to simultaneously allow rapid changes, the tool advantageously is provided with a spring-loaded head connected to it and mounted on it, the pressure-plate of said head acting on various pressure pins mounted in the upper part and guided therein so as to be displaceable and being of a length equal to the thickness of the upper part, further compression bolts being mounted in the base plate to be mounted to the upper part of the overall blanking tool, said bolts being flush with the pressure pins in the upper part. The overall blanking tool may then be removed by detaching its base plate from the upper part in the manner already described, the pressure pins remaining in the upper part and the compression bolts in the base plate of the overall blanking tool. Quick changing of the various overall blanking tools or interchange with die-plates of another kind hence is easily effected in this manner.

The invention is discussed in greater detail below by means of the embodiments shown in the drawing.

Figure 1:
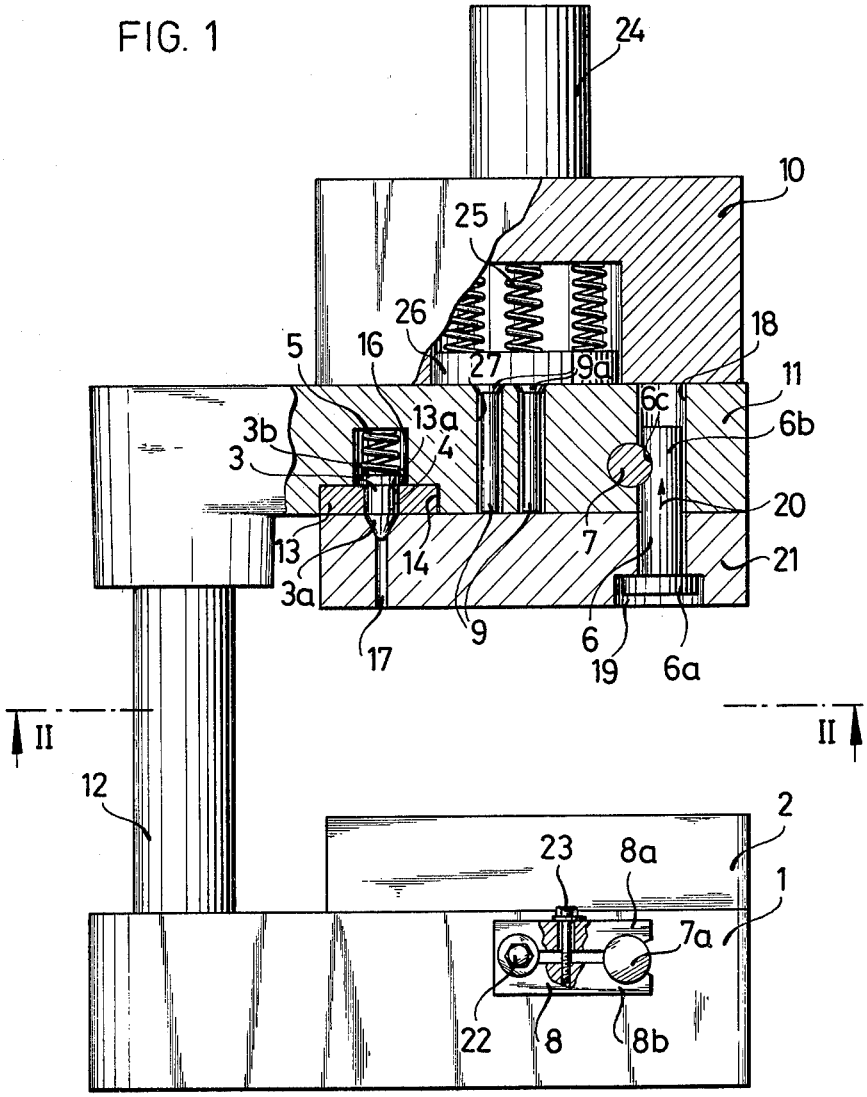
FIG. 1 is a side view and a partial section of an embodiment of the invention.

FIG 1 shows a stamping and cutting tool consisting of a post structure with a lower part 1 and an upper part 11. Upper part 11 and lower part 1 are connected by two guide posts 12 (see FIG. 2) and may move relative to each other. Die-plates 2 and 21 are exchangeably mounted to upper and lower parts.

Figure 2:
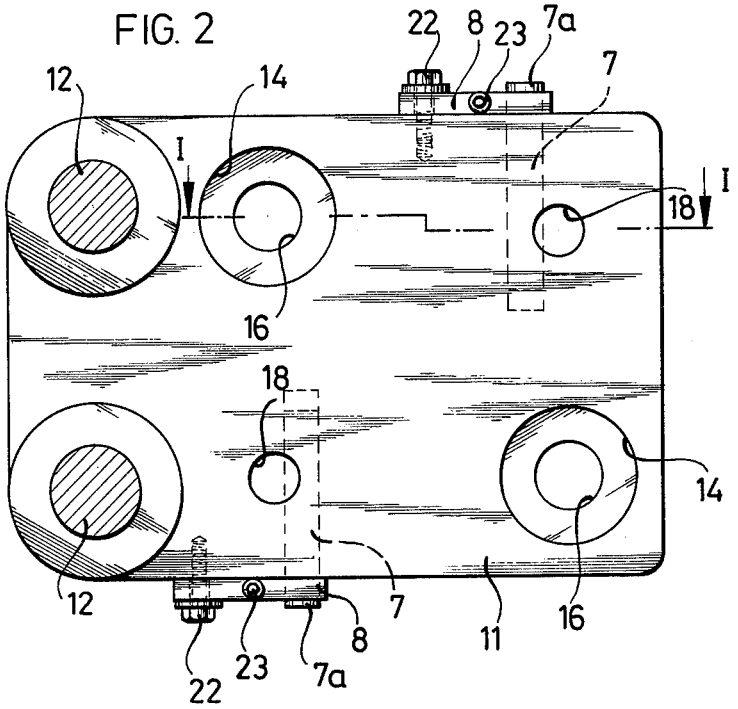
FIG. 2 is section II—II of FIG. 1.

Two centering pins 3 are provided for the embodiment shown in FIGS. 1 and 2, each pin being provided with a conical tip **3*a*. Pins 3 are provided at their back ends with flanges 3*b* which are loaded by strong springs 5 which in turn are mounted inside bores 16 in the upper or lower part. Flanges 3*b* simultaneously act as stops to prevent centering pins 3 from dropping out the upper or lower part. Pins 3 to that end are guided in an insert 13 fitted into a clearance 14 in the upper or lower part. Flange 3*b* of each particular centering pin 3 is of a larger diameter than fitting borehole 13*a* in insert 13, so that — as shown — the flange compressed by spring 5 will rest on the inside surface of insert 13**.

Hollow-conical recesses 4 in die-plates 2 or 21 are associated with the conical tips **3*a* of centering pins 3, and said recesses 4 may be communicating at their tips with throughholes 17 of lesser diameter. Tips 3*a* and hollow-conical recesses 4 are machined for a close fit so that the cutting plate will be trued when assembled and so that tips 3*a* under load will penetrate recesses 4**.

For the embodiment shown, the clamping systems are clamping bolts 6 of which heads **6*a* penetrate a clearance 19 of cutting plates 2 or 21 and of which the shanks 6*b* enter bores 18 of upper part 1 or lower part 11. The particular shank 6*b* is provided at its surface with a somewhat circular recess 6*c* penetrated by a clamping pin 7 of eccentric cross-section, said clamping pin being guided approximately horizontally in the upper or lower part. Rotating clamping pin 7 results in a locking motion of bolt 6 in the direction of arrow 20** on account of the eccentric design of said pin.

The free end of clamping pin 7 horizontally projects outward from the upper or lower part (FIG. 2); it may be secured by a locking system 8, and thus lock all of said pin. Locking system 8 consists of a forklike bracket overlapping free end **7*a* of clamping pin 7, as shown. Bracket 8 is fastened by means of a screw 22 to the upper or lower part, and its two prongs 8*a* and 8*b* may be tightened relatively to each other by means of a further screw 23. Free end 7*a* of clamping pin 7 is clamped in this manner between prongs 8*a* and 8*b***.

In order to be able to use so-called overall blanking tools in the die-set of the invention, a so-called spring-head 10 may be put on upper part 11 and be connected with it, said spring-head being provided with a lug or trunnion 24 to lock the tool in the machine. As shown in schematic form, spring-head 10 is provided with a pressure-plate 26 loaded by springs 25 that acts on pressure pins 9, latter being guided in bores 27 within upper part 11. The length of these pressure pins 9 corresponds to the thickness of upper part 11. Pressure pins 9 are provided with conical heads **9*a* so as to prevent them from falling out of upper part 11. As will be further described below, pins 9 may act on pressure bolts 28** (FIG. 5) of an overall blanking tool.

FIG. 2 is the section along II—II of FIG. 1, assuming the presence of a die plate 21, and shows the position and mounting of clamping pin 7, also how its free end **7*a* is fastened by means of locking system 8. FIG. 2 further shows that clearances 14 and associated bores 16 are arranged mutually diagonally so as to house springs 5 and holding piece 13 resp. so that the centering pins 3 will be as far apart as possible. Two bores 18 symmetrically located with respect to the above and housing clamping bolts 6** are aligned on the other diagonal.

Figure 3:
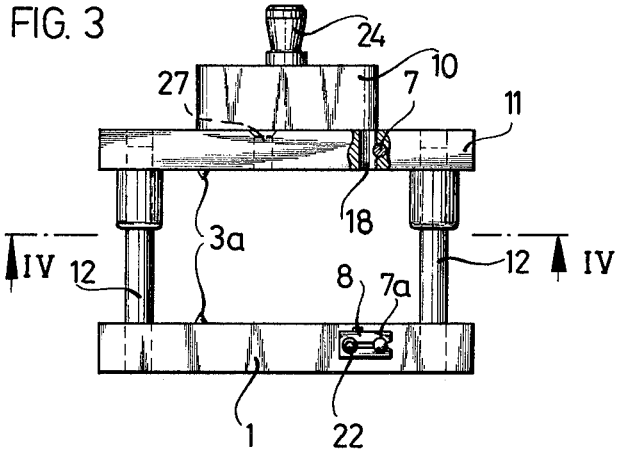
FIG. 3 is another embodiment of the tool.
Figure 4:
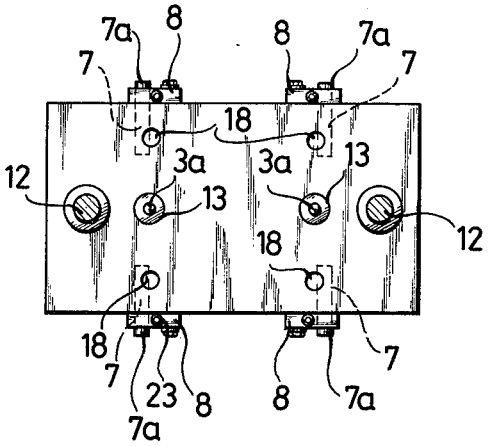
FIG. 4 is section IV—IV of FIG. 3.

FIG. 3 shows another embodiment wherein the die plates are located between two guide posts 12. As indicated by the associated section IV—IV of FIG. 4, two bores 18 for housing one clamping bolt 6 each are associated with every clearance 14, so that four clamping systems are provided in this embodiment. If very large and very heavy plates must be used, four guide posts may be employed; these are located at the corners of the upper and lower parts.

Figure 5:
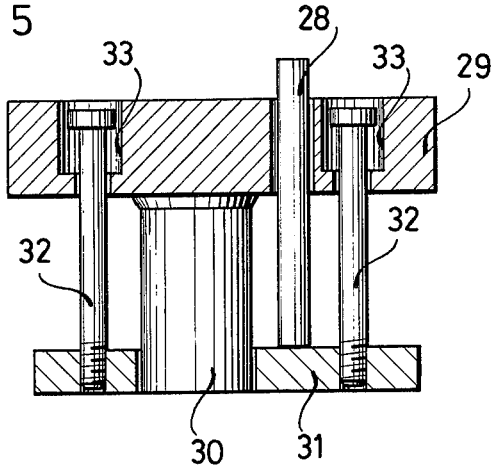
FIG. 5 shows schematically and in partial section an embodiment of the so-called overall blanking tool.

FIG. 5 schematically shows a so-called overall blanking tool which may be mounted to upper part 11 in the manner described above in lieu of die plate 21. The overall blanking tool consists of a base plate 29 through which are guided several pressure bolts 28, only one being shown in FIG. 5. Pressure pins 9 (FIG. 1) corresponding to these pressure bolts 28 are located in upper part 11. A punch 30 is provided in the embodiment shown, comprising a wiper 31 which is held by bolts 32 of which the heads are guided in bores 33 in base plate 29.

When punch 30 enters a corresponding opening of a die plate 2 with its lower end, wiper 31 resting on cutting plate 2 will be lifted, connecting bolts 32 and pressure bolts 28 also thereby being lifted. Pressure bolts 28 in this process act on the pressure pins 9 in upper part 11 (FIG. 1) which are aligned with them and move pressure plate 26 upward against the opposition of springs 25. If now punch 30 is removed from the associated recess during a back motion of upper part 11, springs 25 force pressure plate 26 downward, whereby pressure pins 9 and pressure bolts 28 cause wiper 31 to move down too.

Despite this additional operation in the tool, this overall blanking tool may be changed as easily as a die plate.

I claim:

1. In a stamping and cutting die set having exchangeable die plates located in a plane and comprising an upper part, a lower part and guide means connecting said upper part and said lower part and securing at least one cutting die and at least one clamping system for said at least one cutting die, the improvement comprising:

a plurality of centering pins, each having a conical tip and located in said upper part and said lower part, boreholes located in said upper part and said lower part wherein said centering pins are displaceable, said boreholes extending normally to said plane of the die plates, springs loading said centering pins and projecting said conical tips in the direction of said stamping and die set when said die plates are removed, hollow conical recesses in said die plates corresponding to and receiving said conical tips, said springs providing pre-loading on said centering pins when said die plates are locked by said at least one clamping system, said at least one clamping system comprising a bolt having a shank with approximately circular shape and a head on said bolt, a bore in said corresponding upper or lower part, a recess in said corresponding die plate, said shank extending through said bore and said head resting in said recess, a clearance between said shank and said bore, a rotating eccentric clamping pin guided horizontally in said upper or lower part entering said clearance and drawing said bolt toward said upper or lower part.

2. The die set of claim 1, wherein said centering pins have back ends each provided with a flange of larger diameter and loaded by second springs located in second bores of said upper or lower part, said flange acting as stop and preventing said centering pins from falling out of said boreholes.

3. The die set of claim 2, wherein inserts are located in said boreholes and said centering pins covering said second bores and house said second spring.

4. The die set of claim 1, defining a post structure and provided with two guide posts mounted on one side next to said die plates, wherein said centering pins are provided for each of said upper and lower parts, said centering pins arranged diagonally with respect to the surface of said die plates, while two of said clamping systems are mounted symmetrically with respect to said centering pins on another diagonal.

5. The die set of claim 1, defining a post structure and provided with at least two guide posts between which are located said die plates wherein said centering pins are provided for each of said upper and lower parts, said centering pins aligned with said guide posts and two of said clamping systems are mounted next to each of said centering pins on both sides.

6. The die set of claim 1, wherein said clamping pin when in its clamping position is secured by said locking system mounted externally to said upper or lower part.

7. The die set of claim 6, wherein said locking system comprises a forklike bracket having prongs overlapping an end of said clamping pin which projects from said upper or lower part and of which a collar is screwed to said upper or lower part and said prongs are tightened by a screw.

* * * * *